United States Patent [19]

Inada

[11] Patent Number: 4,481,798

[45] Date of Patent: Nov. 13, 1984

[54] DOOR LOCK

[76] Inventor: Takhi Inada, No. 17-7, Tai Chung Kan Rd., Sec. 2, Taichung, Taiwan

[21] Appl. No.: 351,352

[22] Filed: Feb. 23, 1982

[51] Int. Cl.[3] ..... E05B 21/00; E05B 25/00

[52] U.S. Cl. ..... 70/349; 70/355

[58] Field of Search ..... 70/348, 349, 478, 484, 70/353–355

[56] References Cited

U.S. PATENT DOCUMENTS

| | | | |
|---|---|---|---|
| 17,681 | 6/1857 | Johnson | 70/354 X |
| 20,716 | 6/1858 | Johnson | 70/355 |
| 1,078,192 | 11/1913 | Goldman | 70/355 |
| 1,552,307 | 9/1925 | Jerling | 70/355 X |
| 2,750,787 | 6/1956 | Capdevila | 70/355 X |
| 3,654,783 | 4/1972 | Sinclair | 70/349 |

*Primary Examiner*—Thomas J. Holko
*Assistant Examiner*—Thomas J. Dubnicka

[57] ABSTRACT

A door lock comprises, a casing; means rotatably mounted in the casing for actuating a lock bolt between the locking position and release position of the lock; means for locking said rotatable means against rotation when the lock is in its locking position, the locking means capable of relieving the rotatable means from locking when the key is inserted and the rotatable means is turned by an external action that does not route through the key.

6 Claims, 6 Drawing Figures

DOOR LOCK

BACKGROUND OF THE INVENTION

This invention relates to a lock particularly but not exclusively for doors, windows and the like.

In common practice a key operated lock is actuated to be in a release position by inserting a key which must be turned to work with the inside mechanism of the lock. Therefore such types of key generally have a bowl portion to be held by a hand for turning. When a number of keys are to be carried by a person the keys in a bundle are preferably, sometimes necessarily, compact so that they can be stowed in any small pocket.

SUMMARY OF THE INVENTION

A door lock according to the invention comprises, a casing; means rotatably mounted in the casing for actuating a lock bolt between a locking position and a release position of the lock; means for locking the rotatable means against rotation when the lock is in its locking position, the locking means being capable of relieving the rotatable means from locking when the key is inserted and the rotatable means is turned by an external action that does not route through the key.

In one embodiment of the invention, the rotatable means comprises a cam member; a shaft with one end inserted into the cam member and the other end extending outwardly of the casing; and a link member connected to the cam member for actuating a lock bolt.

In another embodiment of the invention, the locking means comprises a catch member and tumbler means separately movably mounted in the casing, the catch member being normally biased in a first direction for engagement with the cam member, the catch member and tumbler means having a first engagement that prevents a movement of the catch member in a direction opposite to the first direction for locking the cam member against rotation when the lock is in its locking position, and a second engagement that allows the movement for further rotation of the cam member when the lock is in its release position, the second engagement occuring when the tumbler means is engaged with the right key bit.

Preferably, the catch member is longitudinally disposed near the cam member with its intermediate portion pivoted, the upper end thereof biased into engagement with the cam member, and the lower end thereof being engaged with the tumbler means.

In a further embodiment of the invention, the tumbler means comprises a support pivoted in the casing, a plurality of tumbler plates held by the support, the support biased for engagement with the cam member in a second direction when the cam member is a non-rotating position, and turned an angle relative to the second direction when the cam member rotates so that the tumbler plates are engaged with a correct key bit when the key is inserted, each tumbler plate having an end notch and the end notches being aligned when the tumbler plates and the keys are engaged with one another, the second engagement being formed by the engagement of the aligned notches and the lower end.

In a still further embodiment of the invention, the cam member is a cylinder having a laterally cut groove thereon, and the rotatable means further comprises, a spring plate provided along the groove, an annular plate, having a recess at its periphery, coupled with the cam member, the support biassed to be engaged with the recess in the second direction and turned to an angle relative to the second direction when the annular plate rotates to move the recess apart from the support.

In still another embodiment of the invention, the rotatable means comprises, a hollow cylinder having a toothed member provided in the periphery of the cylinder and first bores in the wall thereof; a gear member meshing with the teeth member and having a shaft extending outwardly of the casing; a link member connected with the cylinder. The locking means comprises a stationary key plug member, inserted in the hollow cylinder, having second bores aligned with the first bores; spring loaded tumbler means in the aligned bores for locking the hollow cylinder against rotation when the lock is in its locking position, the tumbler means responsive to the shape of the key bit for relieving the hollow cylinder from locking.

An object of the invention is to provide a novel lock in which its locking action and release action are performed without turning the inserted key.

Another object of the invention is to provide a lock adaptable to work with a compact key which has no handle portion.

A further object of the invention is to provide a lock operable with a key having a thickness as thin as about 1 mm inasmuch as the key will not be subjected to any torque during application.

BRIEF DESCRIPTION OF THE DRAWINGS

These and other objects, features and advantages of the present invention will be more apparent in the following description of the preferred embodiments with reference to the accompanying drawings, in which.

DETAILED DESCRIPTION OF THE PREFERRED EMBODIMENTS

Figures 1, 1A:
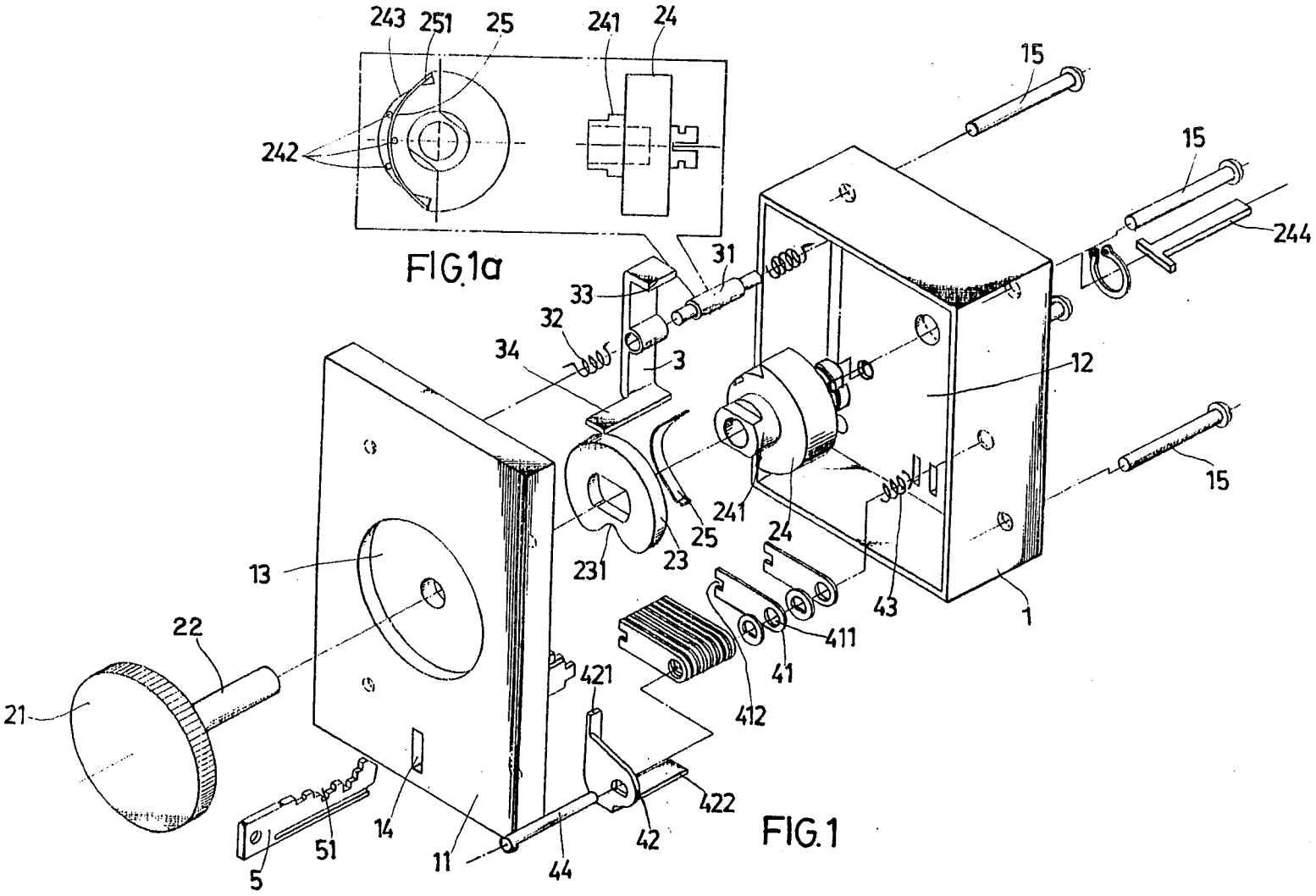
FIG. 1 is an exploded view of a first embodiment in this invention.
FIG. 1*a* shows the assembly of a cam wheel, an annular plate and spring plate of the invention.
Figure 2:
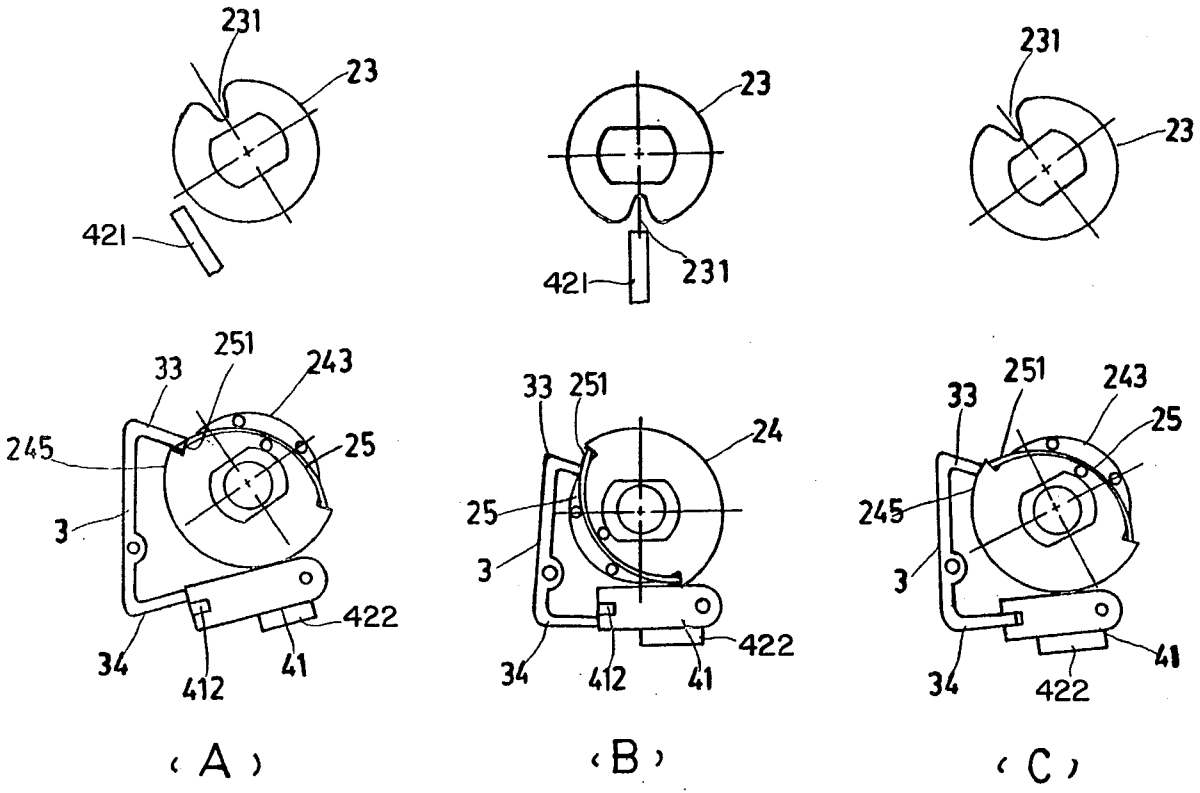
FIG. 2*a* is a view illustrating the engagement of a cam member, annular plate, catch member and tumbler means when the cam member is turned in the absence of the key.
FIG. 2*b* is a view illustrating the engagement of a cam member, annular plate, catch member and tumbler means when the cam member is not turned.
FIG. 2*c* is a view illustrating the engagement of a cam member annular plate, catch member and tumbler means when cam member is turned in the presence of the key.

As shown in FIGS. 1 and 1a, a first embodiment of the invention includes a rectangular casing 1 which has a front cover plate 11 provided with a circular recess 13 to receive a button head 21 in part, and a key hole 14. The button head 21 has a shaft 22 extending into the casing 1 through a hole on the front plate 11 and a cam wheel 24 is mounted on the end of the shaft 22. The cam wheel 24 has a forwardly projecting core 241 to be fitted into an annular plate 23 which has a recess 231 at the periphery thereof. A spring plate 25 is attached to the cam wheel 24 by means of fulcrum 242 (as better shown in FIG. 1*a*) along a laterally cut groove 243. At the rear portion of the cam wheel 24 is attached with a link member 244 which extends outwardly of the casing. The rear plate 12 and front cover 11 are fixed together by means of rivets 15.

A catch member 3 is mounted on a pivot pin 31 and is biased by springs 32 so that the upper end 33 is engaged with the cam wheel 24 as shown in FIGS. *2a, 2b, & 2c* when the lock is in its locking position and release position.

A plurality of tumbler plates 41 with end notches 412 are held by a support 42 which has a projection 421 and base plate 422 on which the tumbler plates 41 rest. The support 42 is mounted on a pivot pin 44 and is loaded with a spring 43 which biasses the support to be engaged with the plate 23 as shown in FIGS. *2a, 2b, & 2c.* The pin 44 is, passing through the tumbler plates 41, ectends through holes 411, each of which is greater than the cross-section of the pin 44 so that the tumbler plates can freely rotate about the pin 44. When the annular plate 23 and cam wheel 24 are in nonrotating position the projection 421 is engaged in the recess 231 as shown in FIG. *2b* so that the tumbler plates 41 are held substantially in a horizontal position wherein the end notches 412 are not in an alignment. The lower end 34 of the catch member 3 is engaged with the tumbler plates 41.

To put the lock in a release position, first key 5 is inserted into the key hole 14 and then button head 21 is turned in a clockwise direction. As the annular plate 23 rotates the recess 231 moves apart from the projection 421 and then engages the convex portion of the annular plate 23. At that time the base plate 422 is turned to an inclining position as shown in FIG. *2c.* In this way tumbler plates 41 will freely drop into the recesses 51 of the key bit and the notches 412 will comes into an alignment. On the other hand the rotation of the cam wheel 24 makes the end 251 of the spring plate 25 move towards the upper end 33 of the catch member 3. When the end 251 reaches the upper end 33 it will be subjected to a pressure from the upper end 33, and, as the result of this, the spring plate 25 will actuate the upper end 33 into engagement with the steeply rising cylindrical surface portion 245 and accordingly this will make the lower end 34 move forwards. As the notches 412 form an alignment the lower end 34 just enters into the notches 412 and thereby allows the movement of the upper end 33 from the cut groove 243 to the cylindrical surface portion 245 for further rotation of the cam wheel 24 to actuate the lock bolt (not shown) through the link rod 244.

If there is no key or a wrong key, inserted, notches 412 will not be in an alignment and therefore the lower end 34 will be prevented from forward movement by the tumbler plates 41. The spring end 251, instead of biasing the upper end 33, will be depressed by the upper end 33 when the cam wheel 24 rotates. Accordingly the upper end 33 will lock the cam wheel 24 against rotation. In this invention as the rotation of the cam wheel 24 is accomplished by turning the button head 21 the function of the key 5 is only to align the notches 412 by their engagement and therefore the key will not be subjected to any torque during application.

Figure 3:
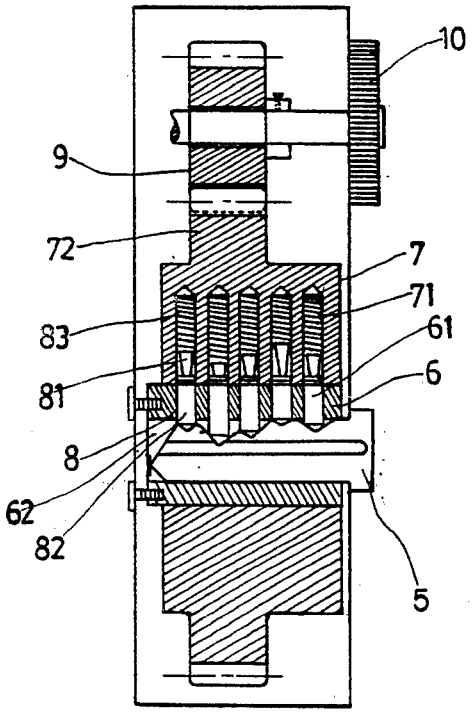
FIG. 3 is a schematic sectional view of a second embodiment in the invention.

In a second embodiment, a lock, as shown in FIG. 3, includes a stationary cylindrical key plug 6 which has a plurality of bores 61 in the wall thereof. A hollow cylinder 7 is movably sleeved onto the key plug 6 and has a plurality of bores 71 in the wall thereof. The bores 61 and 71 are aligned respectively and spring loaded tumbler pins 8 are respectively provided in the aligned bores 61 and 71. On the periphery of the hollow cylinder 7 are provided a plurality of gear teeth 72 which are meshed with a gear 9 turned by an external button head 10.

The tumbler pins 8 include two segments 81 and 82 and are biased by the springs 83 toward the key hole 62. When the lock is in its locking position the segments 81 extend into the bores 61 so that the hollow cylinder 7 is locked relative to the stationary key plug 6. When the key 5 is inserted into the key hole 62 it acts on the segments 82 so that the segments 81 are pushed against the biasing action of the springs 83 and the segments 82 are moved flush with the outer periphery of the key plug 6. At that time, if the gear 9 is turned through the button head 10 it will rotate the hollow cylinder 7, thereby placing the lock in a release position.

With the inventions thus explained, it is apparent that obvious modifications and variations can be made without departing from the scope of the invention. It is therefore intended that the invention be limited only as indicated in the appended claims.

What I claim is:

1. A door lock, comprising:

a casing;

means, rotatably mounted in said casing, for actuating a lock bolt between a locking position and a release position, said actuating means including a cam member, a shaft having one end inserted into said cam member and another end extending outwardly of said casing, and a link member connected to said cam member for actuating said lock bolt; and means for locking said actuating means against rotation when the lock bolt is in its locking position, said locking means releasing said actuating means from said locking position when a key is inserted and said actuating means is rotated by external action that does not route through the key.

2. A door lock as claimed in claim 1, wherein said locking means comprises a catch member and tumbler means separately movably mounted in said casing, said catch member being normally biased in a first direction for engagement with said cam member, said tumbler means being normally biased for engagement with said cam member, said catch member and tumbler means having a first engagement that prevents a movement of said catch member in an opposite direction relative to said first direction for locking said cam member against rotation when the lock is in its locking position, and a second engagement that allows said movement for further rotation of said cam member when the lock is in its release position, said second engagement being formed when the tumbler means is engaged with a correct key bit.

3. A door lock as claimed in claim 2, wherein said catch member is laterally disposed near said cam member with its intermediate portion pivoted, and the upper end thereof being biased for engagement with said cam member and the lower end thereof being engaged with said tumbler means.

4. A door lock as claimed in claim 3, wherein said upper and lower ends of said catch member are bent.

5. A door lock as claimed in claim 2, 3 or 4, wherein said tumbler means comprises a support pivoted in said casing, a plurality of tumbler plates held by said support, said support biased to be engaged with said cam member in a second direction when said cam member is in non-rotating position, and turned an angle relative to said second direction when said cam member rotates so that said tumbler plates are held so that said tumbler plates are allowed to be engaged with a correct key bit when a key is inserted, each said tumbler plate having an end notch, said end notches being aligned when the tumbler plates and the key are engaged with one another, said second engagement formed by the engagement of said aligned notches and said lower end.

6. A door lock as claimed in claim 5, wherein said cam member is a cylinder having a laterally cut groove thereon and said actuating means further comprises a spring plate provided along said groove and an annular plate, having a recess at its periphery, coupled with said cam member, said support being biased to be engaged with said recess in said second direction, and turned to an angle relative to said second direction when said annular plate rotates to move the recess apart from the support.

* * * * *

UNITED STATES PATENT AND TRADEMARK OFFICE

CERTIFICATE OF CORRECTION

PATENT NO. : 4,481,798

DATED : November 13, 1984

INVENTOR(S) : Taichi INADA

It is certified that error appears in the above-identified patent and that said Letters Patent is hereby corrected as shown below:

On the title page;

The name of the inventor should read:

[76] Inventor: Taichi Inada instead of Takhi Inada

Signed and Sealed this

*Thirteenth* Day of *August 1985*

[SEAL]

*Attest:*

DONALD J. QUIGG

*Attesting Officer* *Acting Commissioner of Patents and Trademarks*